US007566826B1

(12) United States Patent
Stokdyk

(10) Patent No.: US 7,566,826 B1
(45) Date of Patent: Jul. 28, 2009

(54) FOOT PEDAL DRIVE FOR PLAYING A PERCUSSION INSTRUMENT

(76) Inventor: Jamison Lee Stokdyk, 1712 N. 4th St., Sheboygan, WI (US) 53081

( * ) Notice: Subject to any disclaimer, the term of this patent is extended or adjusted under 35 U.S.C. 154(b) by 0 days.

(21) Appl. No.: 11/867,524

(22) Filed: Oct. 4, 2007

Related U.S. Application Data

(60) Provisional application No. 60/849,232, filed on Oct. 4, 2006.

(51) Int. Cl.
*G10D 13/02* (2006.01)

(52) U.S. Cl. ..... 84/422.1; 84/411 R

(58) Field of Classification Search ..... 84/422.1
See application file for complete search history.

(56) References Cited

U.S. PATENT DOCUMENTS 4,091,706 A * 5/1978 Ludwig ..... 84/411 R
4,691,613 A * 9/1987 Jacobson ..... 84/422.1
4,788,897 A * 12/1988 Kirby et al. ..... 84/422.1
2004/0037079 A1 * 2/2004 Luk ..... 362/252

* cited by examiner

*Primary Examiner*—Jeffrey Donels
*Assistant Examiner*—Christopher Uhlir
(74) *Attorney, Agent, or Firm*—Buskop Law Group, PC; Wendy Buskop

(57) ABSTRACT

A device for playing a percussion instrument using a pedal, a pivoting L-rod secured to a base plate for supporting a retraining assembly with a first stop disposed on one end of the percussion instrument and a second stop disposed on the other end of the percussion instrument, and wherein the first and second stops restrain the pivoting action of the percussion instrument, and wherein a base plate is removably fixedly secured to the pedal clamp.

7 Claims, 3 Drawing Sheets

FOOT PEDAL DRIVE FOR PLAYING A PERCUSSION INSTRUMENT

CROSS REFERENCE TO RELATED APPLICATIONS

The present application claims priority to co-pending U.S. Provisional Patent Application Ser. No. 60/849,232, filed on Oct. 4, 2006.

FIELD

The present embodiments relate generally to musical instruments and specifically to tambourine type percussion instruments.

BACKGROUND

A need exists for an invention which enables a player to play a tambourine with a foot operated device.

A tambourine, as defined here in, is a small drum especially a shallow-headed drum with loose metallic disks at the sides played by shaking, striking with the hand or rubbing with the thumb. The present invention enables a musician to play a tambourine with a mechanical device, which is useful for handicapped people or for musicians that need to use their hands for drumsticks while providing a tambourine sound.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a relate generally to musical instruments and specifically to tambourine type percussion instruments.

The embodiments provide a benefit of enabling a handicapped person without hands to play an instrument, be in a band and be part of a musical experience. The invention helps a handicapped person be part of a group, and have better or at least improved mental health, instead of being isolated.

The device is particularly good for handicapped persons who have lost one or more arms, and still want to play an instrument. The device has therapeutic benefits for handicapped people of all ages. The invention enables a player to play a tambourine with a foot operated device.

By means of providing a double action control, a foot, or a device like a foot, such as a mechanical foot, that is, a prosthesis, can be used to apply pressure to an easy to depress pedal and operate a tambourine.

The device is light, easy to assembly, easy to transport, and even a child can figure out how to operate the mechanical device. The device is sturdy, supported by a base plate that is hard to tip over.

One embodiment contemplates that the entire construction of the device can be made out of lightweight plastic making it easy to clean, lightweight, that is, less than about 2 pounds overall, inexpensive to transport, and easy for a handicapped person to use and maneuver. The embodiment can be made from molded plastic for ease of making and molding, on an assembly line.

In another embodiment, the instrument for striking is contemplated to be a tambourine, however, the pedal device can be used for a gong, chimes, drums, or a side mounted tom-tom or other percussion instrument.

Figure 1:
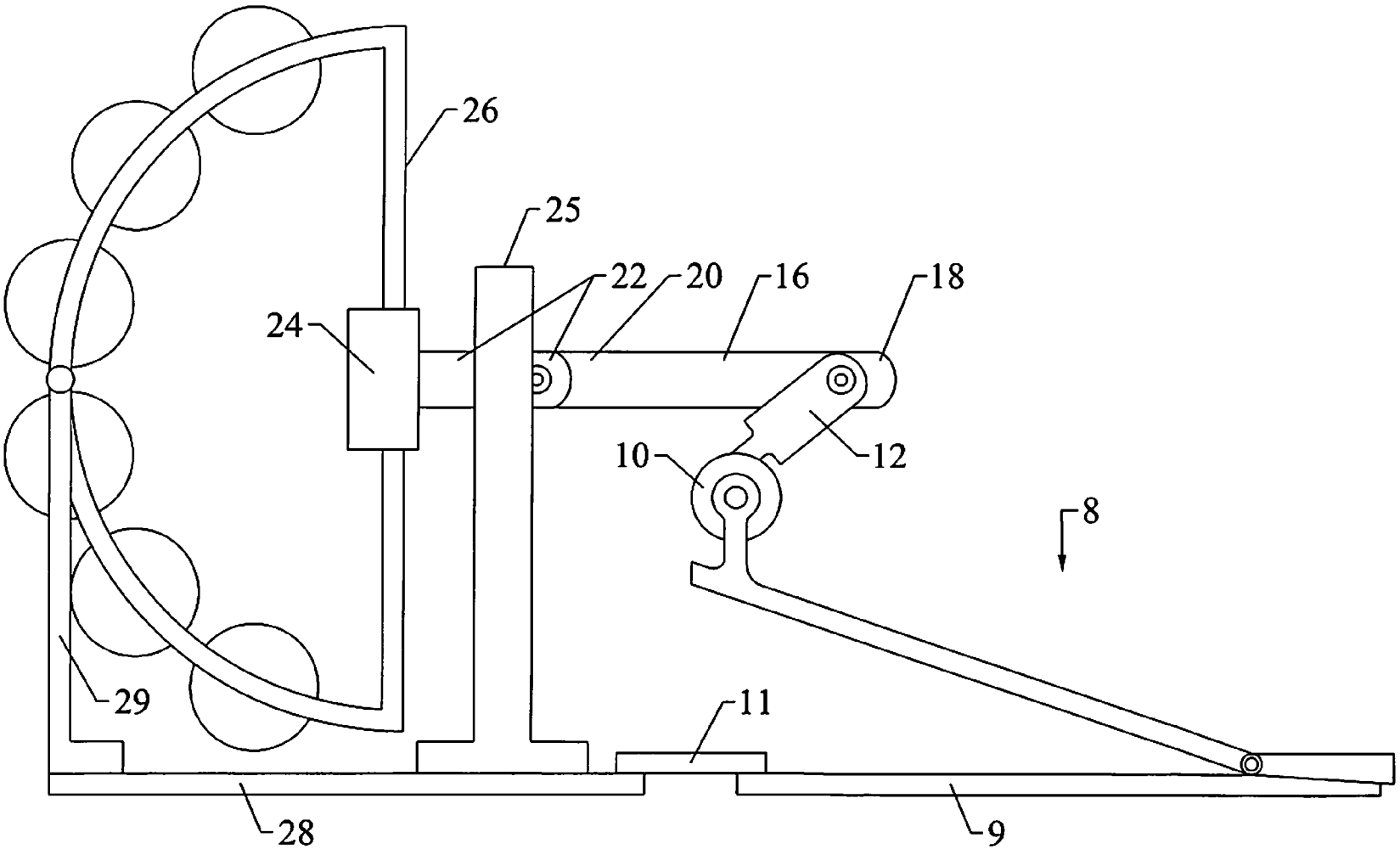
FIG. 1 depicts a side view of an embodiment of the invention.

With reference now to the drawings, FIG. 1 depicts a pedal 8 which is connected to a plate 9 having a top cam 10 and a pedal clamp 11. The pedal is contemplated to be slightly larger than the size of an average man's size foot. The pedal can be made from metal, with slight ribbing to prevent slippage during play. The pedal in another embodiment is contemplated to have an edging to help hold the pedal in place. The top cam could be metal, between about 6 inches to about 20 inches long.

The invention comprises a first rod 12 which is fixedly secured to the top cam 10. The first rod can be screwed to the top cam or even welded to the top cam. If the top cam is made from plastic, the rod can be plastic welded to the top cam. The first rod has a bearing 14 on the side opposite the top cam 10. The first rod can be about 4 inches to about 12 inches in length for optimum use, and can be a solid rod, such as a solid polymer rod, or can be a hollow sturdy tube, such as a stainless steel tube.

A second rod 16 has a first end 18 that secures to the bearing 14. The second rod 16 also has a second end 20. The second rod can be between about 4 inches to about 12 inches in length and can be a solid rod, or a sturdy metal tube.

A pivoting L-rod 22 is secured to the second end 20 of the second rod 16. The pivoting L-rod has a clamp 24 and a L-rod brace 25. The L-rod can be formed by two tubulars pivotably connected together, or can be formed by two flat bars to form a L-shaped connector. Each segment of the L-rod is contemplated to be between about 2 inches to about 6 inches in length. The L-shape is not contemplated to be moveable into other shapes. The L-shape is critical to the ease of playing of the instrument.

Figure 2:
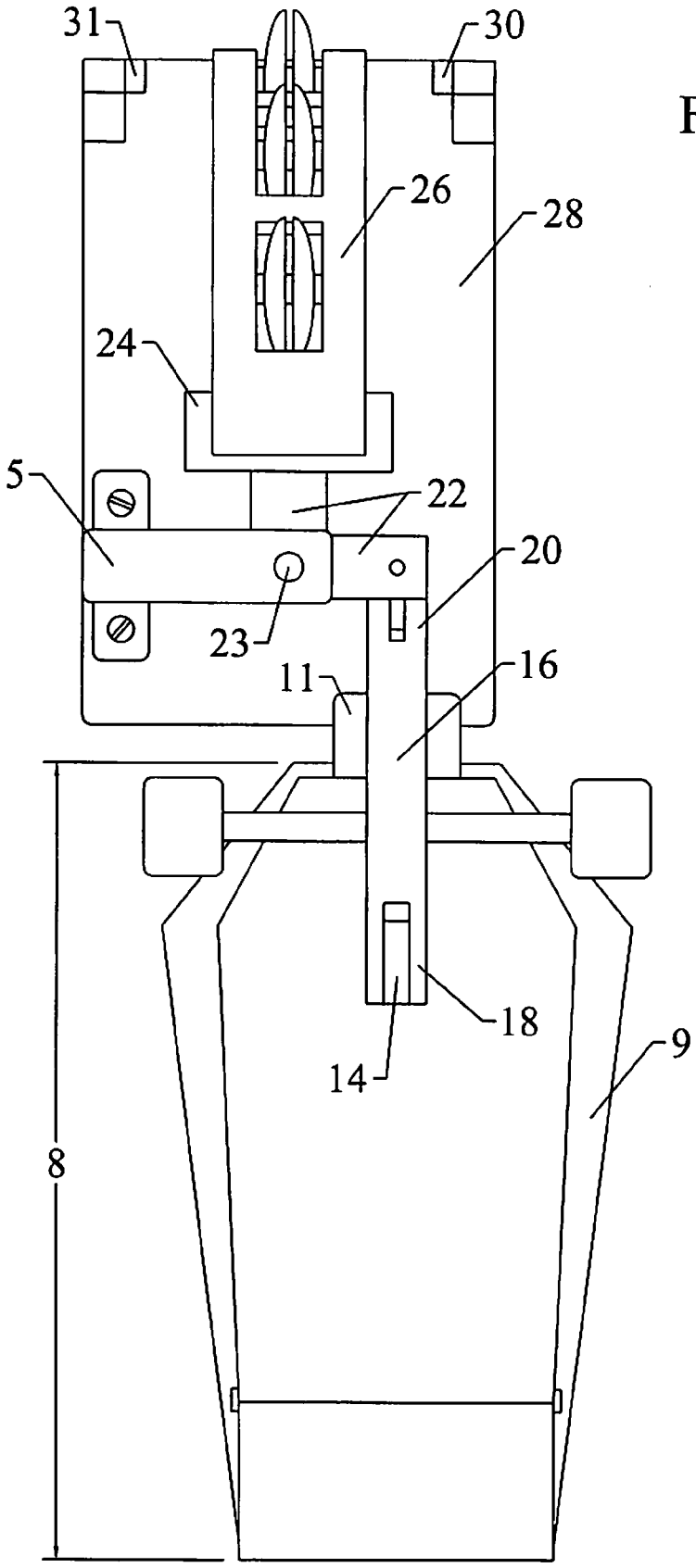
FIG. 2 depicts a top view of an embodiment of the invention.

The L-rod pivots around a bearing 23, as shown in FIG. 2, that is in the center portion of the L-rod, between the two legs. The two legs of the L-rod can be of differing lengths or the same length. The L rod can be made of solid steel, or a flat tubular, or channel. The L rod can pivot up to about 180 degrees.

A tambourine 26 can be held by the clamp 24. The clamp 24 can be wing nut style clamp, enabling the tambourine to be removeably secured to the clamp. In addition, this Figure depicts a base plate 28 supporting a restraining assembly 29.

FIG. 2 shows a top view of the restraining assembly 29 holding the tambourine 26. The restraining assembly has a first stop 30 and a second stop 31. The base plate 28 further supports the L-rod brace 25. The first stop 30 is disposed on one side of the tambourine and the second stop 31 is disposed on the other end of the tambourine or similar musical instrument.

The first and second stops restrain the pivoting action of the tambourine in the clamp.

The base plate is removably fixedly secured to the pedal clamp. This removability enables the device to be taken apart and collapsed flat for ease of transport.

The tambourine is oriented to enable the first rod to rotate the top cam, pushing the second rod forward when the foot pedal is depressed. That is, the first rod rotates on the top cam pushing the second rod forward, which rotates the L-rod around the L-rod brace, which in turn, causes the tambourine to strike the first stop 30. When the foot pedal is release, the tambourine rotates to strike the second stop 31. The musician repeats this action to make sound.

In an embodiment, the entire invention can be made from aluminum, which can resist rust and is cost effective.

Figure 3:
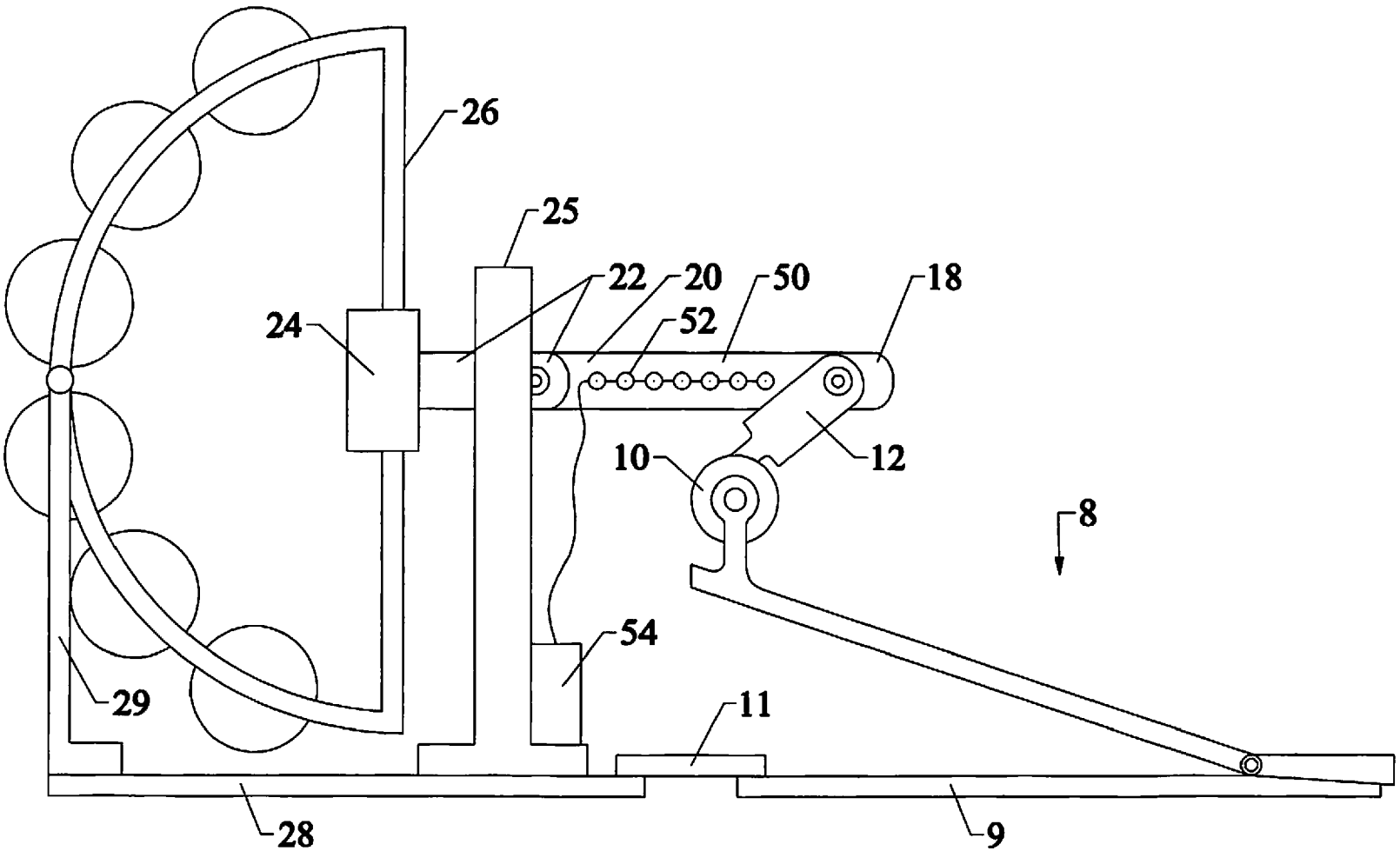
FIG. 3 depicts a side view of an embodiment of the invention.

FIG. 3 illustrates another embodiment where the invention can be made from plastic with all the parts being hollow. The second rod is illustrated as a hollow tube 50. Light cords, illustrated as a string of LEDs 52, can be placed into the hollow tubes, and the entire device can be illuminated when played. The lights can be connected to a battery pack 54 on the floor adjacent the pedal. In another embodiment, a light kit can be used by simply plugging into a power cord or extension cord from a alternative power source.

The invention can be painted or embossed, or embellished to create a marketing tool as well as musical instrument playing device. The embodied device can be used to promote the name of the band or the name of the tambourine manufacturer.

The lighted embodiment further comprises that the lights can be light emitting diodes "LED" lights, which can be powered by a battery or AD adapter connectable to a wall socket. The tubes of the embodiment can be light transmitting or light passing materials, such as a light plastic that lets lights disposed in the tubes emit light out of the tubes, enabling the musician to read music and to be a feature in a band without being in the spotlight.

Still another embodiment contemplates that the pedal operation can be remote to the tambourine device, that is the foot pedal can be at between about 3 feet to about 10 feet away from the tambourine, and a cable mechanism can be used between the user and the instrument to operate the pivoting action of the L-rod. A handicapped person with no legs could in fact run the instrument using a small motor attached to the pedal.

While these embodiments have been described with emphasis on the embodiments, it should be understood that within the scope of the appended claims, the embodiments might be practiced other than as specifically described herein.

What is claimed is:

1. A foot operated musical instrument playing device comprising:

a pedal comprising a top cam and a pedal clamp;

a first rod fixedly secured to the top cam wherein the first rod has a bearing opposite the top cam;

a second rod having a first end and a second end, wherein the second rod is secured to the bearing;

a pivoting L-rod secured to the second end, wherein the pivoting L-rod further supports a clamp for holding a musical instrument and an L-rod brace, and wherein the L-rod is configured in a plane perpendicular to a plane formed by the first rod and the second rod, whereby the L-Rod translates motion of the second rod from the plane to the first rod and the second rod to a plane perpendicular to the plane of the first rod and the second rod; and a base plate for supporting a restraining assembly connected to the L-rod brace, comprising a first stop and a second stop, and wherein the first stop is disposed on one side of the musical instrument and the second stop is disposed on the other end of the musical instrument, and wherein the first and second stops restrain the pivoting action of the musical instrument in the clamp, and wherein the base plate is removably fixed to the pedal clamp.

2. The device of claim 1, wherein the each of the pedals, rods and plates are constructed from a member selected from the group comprising: a metal, a plastic, and combinations thereof.

3. The device of claim 1, wherein the musical instrument is a tambourine or a gong.

4. The device of claim 1, wherein the pivoting L-rod pivots up to about 180 degrees.

5. The device of claim 1, wherein the rods are light transmitting hollow tubes.

6. The device of claim 5, wherein lights inserted in the light transmitting hollow tubes comprise light emitting diodes "LEDs" connected to a power supply for illuminating the device during play.

7. The device of claim 6, wherein the power supply for illuminating the device during play is a battery pack, a light kit, an AD adapter connectable to a wall socket, or combinations thereof.

* * * * *